US005515879A

United States Patent [19]

Mollo

[11] Patent Number: 5,515,879

[45] Date of Patent: May 14, 1996

[54] LOAD SENSED MULTI-PURPOSE PRESSURE CONTROL VALVE

[76] Inventor: James R. Mollo, 209 Julrich Ave., McMurray, Pa. 15317

[21] Appl. No.: 346,606

[22] Filed: Nov. 28, 1994

Related U.S. Application Data

[63] Continuation-in-part of Ser. No. 121,275, Sep. 13, 1993, Pat. No. 5,368,061, which is a continuation-in-part of Ser. No. 784,388, Oct. 29, 1991, Pat. No. 5,244,358, which is a continuation-in-part of Ser. No. 426,750, Oct. 24, 1989, abandoned, which is a continuation-in-part of Ser. No. 211,163, Jun. 22, 1988, abandoned, which is a continuation-in-part of Ser. No. 8,313, Jan. 29, 1987, abandoned.

[51] Int. Cl.[6] ..... F15B 13/02; F16K 17/10

[52] U.S. Cl. ..... 137/115; 91/451; 137/269; 137/489; 137/596.12; 137/596.13; 137/599.2

[58] Field of Search ..... 91/451; 137/115, 137/269, 489, 596.12, 596.13, 599.2

[56] References Cited

U.S. PATENT DOCUMENTS

| | | | |
|---|---|---|---|
| 2,305,519 | 12/1942 | Dunmire | 137/53 |
| 3,324,881 | 6/1967 | Madison | 137/596.13 |
| 3,373,763 | 3/1968 | Smilges et al. | 137/489 X |
| 3,379,133 | 4/1968 | McCormick | 103/37 |
| 3,416,561 | 12/1968 | Kokaly | 137/491 |
| 3,455,210 | 7/1969 | Allen | 91/446 |
| 3,488,953 | 1/1970 | Haussler . | |
| 3,718,159 | 2/1973 | Tennis | 137/596.12 |
| 3,722,543 | 3/1973 | Tennis | 137/596.12 |
| 3,811,471 | 5/1974 | Murase et al. | 137/596.13 |
| 3,828,813 | 8/1974 | Haussler | 137/596.13 |
| 3,861,145 | 1/1975 | Hall et al. | 60/427 |
| 3,868,821 | 3/1975 | Ratliff et al. | 60/421 |
| 3,882,896 | 5/1975 | Budzich | 137/596.1 |
| 3,934,742 | 1/1976 | Tennis | 214/762 |
| 4,040,438 | 8/1977 | Wilke | 137/596.13 X |
| 4,043,419 | 8/1977 | Larson et al. | 180/132 |

(List continued on next page.)

FOREIGN PATENT DOCUMENTS

| | | | |
|---|---|---|---|
| 2506923 | 9/1976 | Germany | 137/596.13 |
| 2238355 | 8/1993 | United Kingdom . | |

OTHER PUBLICATIONS

Manual MCV System, 3 pp. (no other available information) (undated).

Oilgear Engineering Data Bulletin No. 80006, pp. 1–3 (no other available information) 1981.

*Hydraulics & Pneumatics*, "Load–sensing Pumps: has their time come? Part 1: Load–and flow–sensing pumps are increasingly important to circuit designers", J. R. Mollo, May 1990, pp. 57, 58, 60, 72, & 74.

*Hydraulics & Pneumatics*, "Load–sensing Pumps: has their time come? Part 2 here are some tips to help designers apply load–sensing pumps", J. R. Mollo, Jul. 1990, pp. 91, 92 & 94.

Load Sense Variable Discharge High Pressure Gear Pump, G20–LS, John S. Barnes Corporation, pp. 1–6 (no other information available) Dec. 1992.

*Primary Examiner*—Gerald A. Michalsky

*Attorney, Agent, or Firm*—Webb Ziesenheim Bruening Logsdon Orkin & Hanson

[57] ABSTRACT

A pressure control valve having a housing with a main inlet passage and a bypass outlet passage. A combined control is located in the housing to control the flow of fluid from the main inlet passage to the bypass outlet passage. The combined control includes a chamber in the housing having an inlet connected to the main inlet passage, an outlet connected to the bypass outlet opening and a loading opening. A poppet is located in the chamber and is movable between a first position closing the inlet and a second position opening the inlet to allow fluid to flow from the main inlet passage to the bypass outlet passage. A spool is positioned within the poppet and is movable between an open position allowing fluid to flow between the main inlet passage and the bypass outlet passage. A spring biases the spool toward the closed position. A connecting passage is located in the housing to connect the main inlet passage to the loading opening.

9 Claims, 5 Drawing Sheets

U.S. PATENT DOCUMENTS

| | | | |
|---|---|---|---|
| 4,122,865 | 10/1978 | Budzich | 137/596.13 |
| 4,159,724 | 7/1979 | Budzich | 137/596.13 |
| 4,520,902 | 6/1985 | Snow | 184/7.4 |
| 4,798,126 | 1/1989 | Budzich | 91/518 |
| 5,048,396 | 9/1991 | Torkler et al. | 137/596.13 X |
| 5,244,358 | 9/1993 | Mollo | 417/310 |
| 5,368,061 | 11/1994 | Mollo | 137/115 |

PRESSURE AFFECTED AREAS
A AND B = LOAD PRESSURE ONLY
C AND D = PUMP DISCHARGE PRESSURE ONLY

AREA RATIOS
A + B TO C + D = 2 TO 1
B TO C = 1 TO 1

LOGIC CHART

| PRESSURE VALVE FUNCTION | AREA AFFECTED | | | | SPOOL OR POPPET ACTION | |
|---|---|---|---|---|---|---|
| | A | B | C | D | SPOOL 32 | POPPET 1 |
| LOW UNLOAD | Z | Z | P | P | C | O |
| PARTIAL OUTPUT FLOW | L | L | P | P | M | C |
| FULL OUTPUT FLOW | L | L | P | P | C | C |
| RELIEF AT LOAD | L | L | P | P | M | C |
| LOAD SENSE DUMP | Z | Z | P | P | C | O |

KEY
Z = ZERO PRESSURE
L = LOAD PRESSURE
P = PUMP DISCHARGE PRESSURE
C = CLOSED OR OFF
O = OPEN OR ON
M = ON AND MODULATING

FIG. 2A

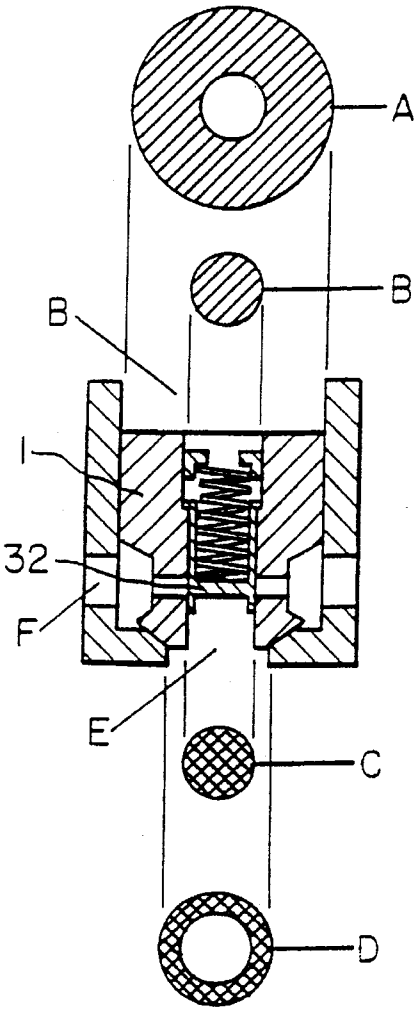

FIG. 2

LOAD SENSED MULTI-PURPOSE PRESSURE CONTROL VALVE

CROSS-REFERENCE TO RELATED APPLICATIONS

The present application is a continuation-in-part of application Ser. No. 08/121,275, filed Sep. 13, 1993, now U.S. Pat. No. 5,368,061, which is a continuation-in-part of application Ser. No. 07/784,388, filed Oct. 29, 1991, now U.S. Pat. No. 5,244,358, which is a continuation-in-part of application Ser. No. 07/426,750, filed Oct. 24, 1989, now abandoned, which is a continuation-in-part of application Ser. No. 07/211,163, filed Jun. 22, 1988, now abandoned, which is a continuation-in-part of application Ser. No. 07/008,313 filed Jan. 29, 1987, now abandoned.

BACKGROUND OF THE INVENTION

1. Field of the Invention

This invention relates to controlling the bypass flow of a displacement pump. The invention provides for controlling the bypass flow in response to external load and/or flow requirements in a load responsive system. The invention also provides an internal response to load in a non-external load responsive system. The invention is a multi-purpose pressure control valve with low unload features.

My application Ser. No. 08/121,275, now U.S. Pat. No. 5,368,061, relates to pumps and the disclosures thereof are incorporated herein by reference. The present application generally relates to pressure control valves. It is beneficial when using pumps in multiple function complex circuits to control the pressure in individual legs of the complex circuits.

Pressure responsive relief valves having unload features limit the working pressure of a system and may, through electrical or pressure sensitive devices, unload hydraulic systems to a low pressure value in one mode of operation.

The operation of a pilot operated relief valve with unload characteristics having a pilot stage relief is well-known. A pilot stage relief is used to unbalance a spring loaded hydrostat which is an equal pressure sensitive device well-known to those skilled in the art. This overcomes problems which exist in direct acting relief valves. This well-known arrangement uses a fixed spring in conjunction with the hydrostat which means that the low unload value of the control can only be equal to the force exerted on the hydrostat plus the fixed spring tension during the unload condition. The spring tension must be such that it prevents instability in the hydrostat during normal relief action and unload action which generally requires a high spring tension obtainable from a heavy gauge spring. The fixed hydrostat spring is not adjustable and the only adjustment of a pilot operated relief valve is the pilot section spring. The low unload pressure in these known relief valves varies with pressure dependent on hydrostat stability, generally from about 80 psi to about 125 psi unload pressure. The pressure response in reference to the pilot section is fixed by the fixed tension hydrostat spring and, therefore, is non-adjustable. The invention described in application Ser. No. 08/121,275, now U.S. Pat. No. 5,368,061, allows the low unload pressure to be set on a separate spring other than the adjustable hydrostat spring, causing the two controls to work independently with a single load sense signal. The combination control allows a low unload of near atmosphere pressure instead of the aforementioned 80 psi to 125 psi, thereby lowering the unload horsepower draw by 95%. The combined control offers fast response and large volume flows while creating small pressure drops in reference to prior art poppet designs, and provides finely metered flow control in reference to the spool type hydrostat. This combination can be used in a variety of configurations, such as a unique pressure relief with a variable pressure cutoff or ramp; a low unload relief operating at pressures near atmosphere; a pressure relief with a variable pressure cutoff or ramp and a low unload relief operating at pressures near atmosphere; an adjustable bypass style compensator; an adjustable bypass style compensator with adjustable relief to bypass; an adjustable bypass style compensator with adjustable relief to bypass and low unload at near atmosphere pressure.

SUMMARY OF THE INVENTION

It is an object of the present invention to utilize combined control to create a multi-purpose pressure control with varying pressure cut-out capabilities and low unload capabilities.

It is another object of the present invention through the use of the combined control to provide a pressure control valve including a variable tension hydrostat spring, thereby making an adjustable pressure cutoff ramp. The adjustable hydrostat spring will compensate for distance and piping pressure losses which occur in remote mounting of control orifices when used as a bypass style compensator.

It is a further object of the present invention through the use of the combined control to cause the pressure control valve to have a low unload pressure to reservoir of 2.5 psi in pressure drop. This is in contrast to a pressure drop of about 125 psi of prior art devices resulting in a 95% horsepower reduction in the relief unload mode of operation.

It is also an object of the invention to provide a pressure control valve which is a combination of an adjustable bypass style compensator with low unload capabilities and an adjustable relief.

A complete understanding of the invention will be obtained from the following description when taken in connection with the accompanying drawing figures wherein like reference characters identify like parts throughout.

BRIEF DESCRIPTION OF THE DRAWINGS

FIG. 2 is a section of a combined low unload bypass control with effective areas;

FIG. 2A is a control logic function chart;

DESCRIPTION OF THE PREFERRED EMBODIMENTS

Figure 1:
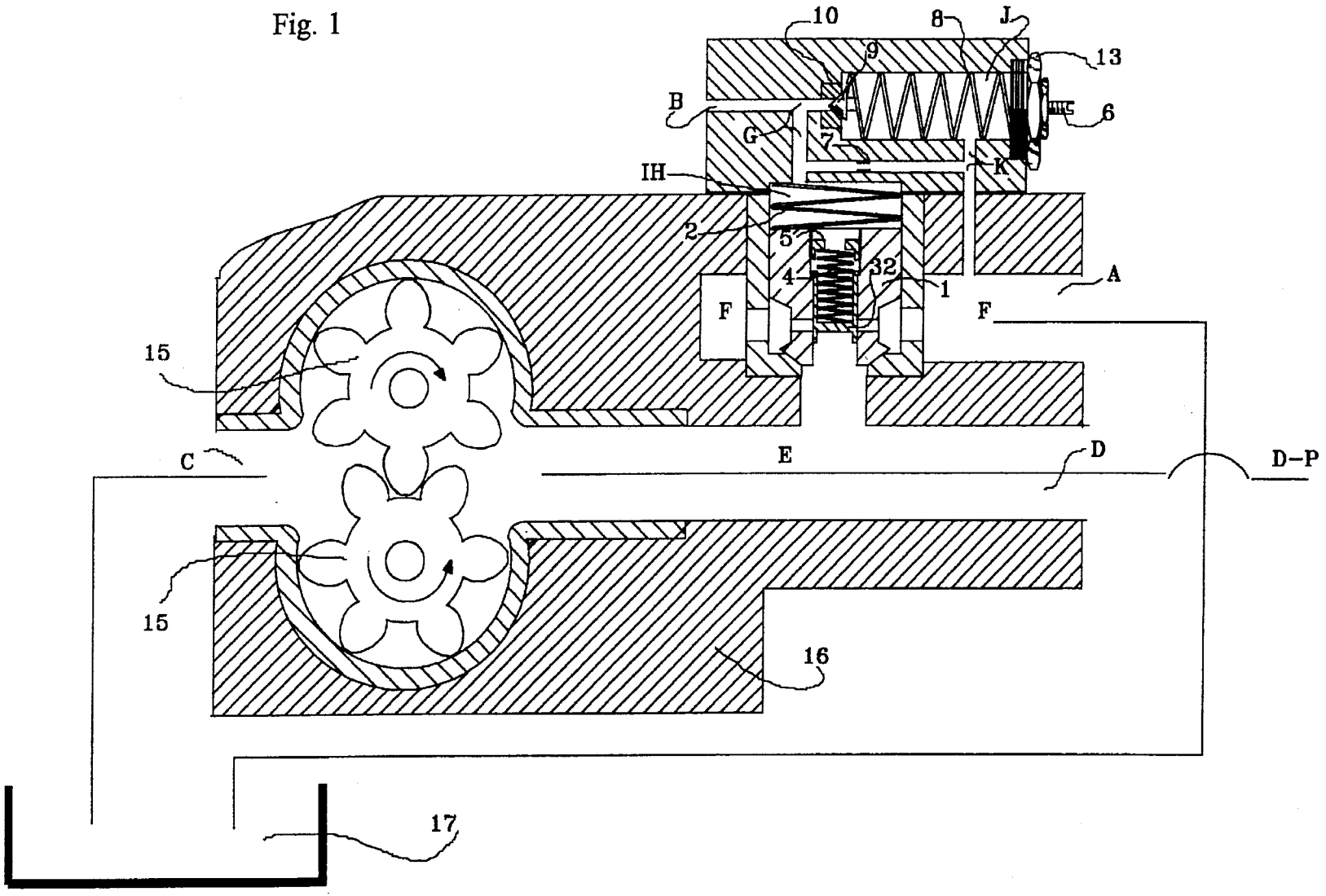
FIG. 1 is a section of a gear pump with a low unload bypass control with a hydrostat having a spool design.

FIG. 1 of the drawings shows a gear pump 16 described in parent application Ser. No. 08/121,275, now U.S. Pat. No. 5,368,061, which is incorporated herein by reference. The pump 16 includes the combined control consisting of a poppet 1, a spool 32, a spring 4, a spring 2 and an adjustment screw 5. Spool 32 is a hydrostat or an equal area pressure sensitive device. Spool 32 includes a 1:1 area ratio in reference to an area of spool 32 acted upon by pressure in chamber IH and an area of spool 32 acted upon by pressure in passage E. Spool 32 is biased by spring 4 toward the closed position. Adjustment screw 5 can vary the tension on spring 4. Spool 32 is positioned within poppet 1. Poppet 1, in the combined control, has a 2:1 pressure effective area ratio in regard to an area of poppet 1 acted upon by pressure in chamber IH and an area of poppet 1 acted upon by pressure in passage E. The unbalanced areas allow spring 2 to be of a generally light gauge. Spring 2 may be removed if a near atmosphere unload condition is required. This means that the effective area on which pressure can be applied to poppet 1 through passage E is 50% less than the effective area on which pressure can be applied to poppet 1 through chamber IH. If the pressure in chamber IH is reservoir pressure or zero, the amount of pressure in passage E required to open passage E to passage F is equal to the amount of pressure exerted on poppet 1 by spring 2.

FIG. 2 of the drawings shows the combined control poppet 1 and spool 32 illustrated in FIG. 1, which function as previously stated and with reference to the simplified logic chart shown in FIG. 2A. The pressure effective areas are designated as A, B, C and D. The load pressure or lack thereof is applied to areas A and B through chamber IH. The pump discharge pressure is applied to areas C and D through passage E. The logic chart in FIG. 2A explains the function of poppet 1 and spool 32 in reference to pump discharge pressure in passage E and load pressure in chamber IH.

Figure 3:
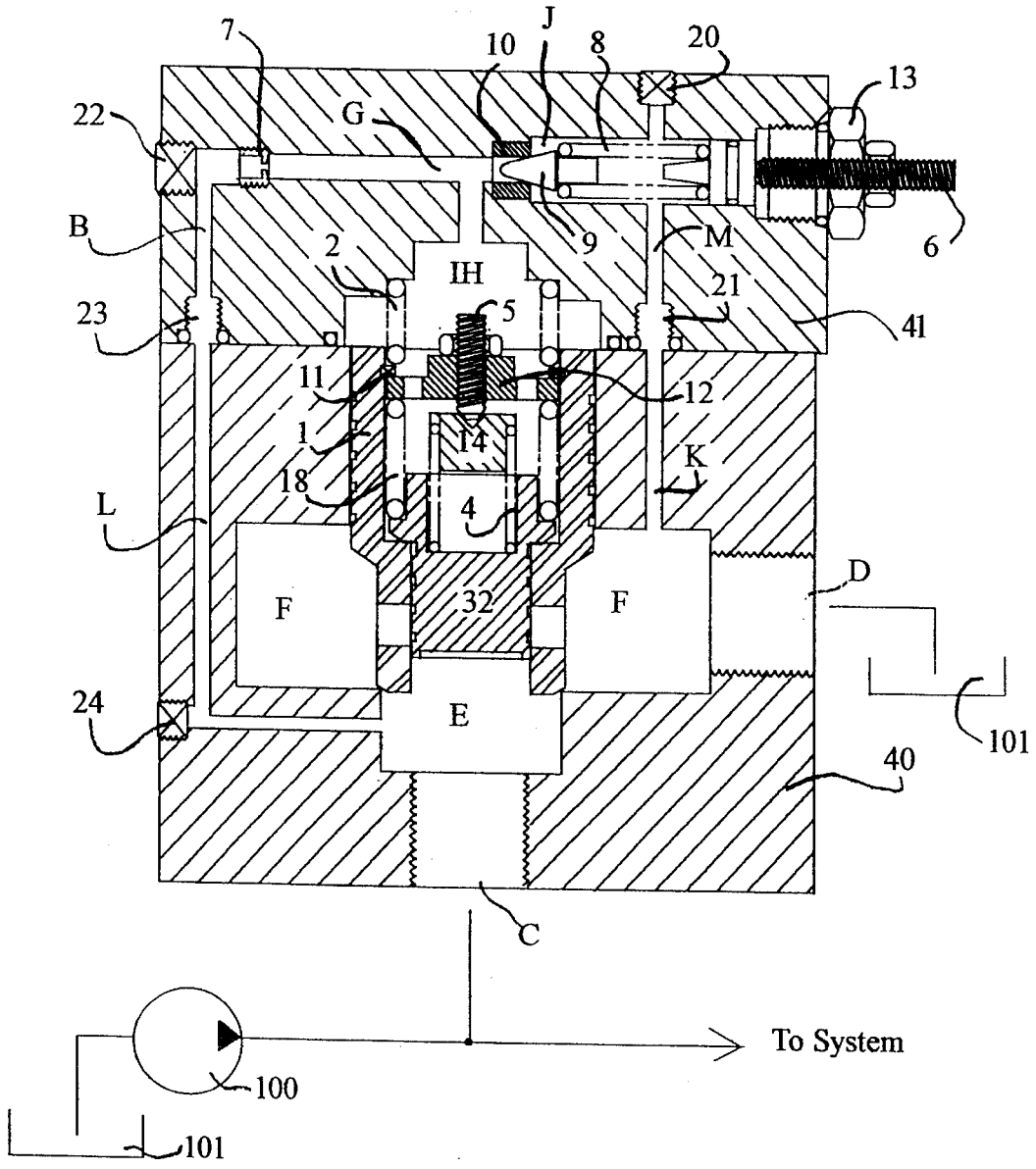
FIG. 3 is a section of a multi-purpose pressure control valve in a pilot relief valve configuration.

FIG. 3 of the drawings shows a multi-pressure control valve 40 which is a standard pilot operated relief valve with an adjustable pressure cutoff. Pump 100 and reservoir 101 are shown schematically. Ports 20, 21, 22, 23 and 24 are illustrated as plugged or threaded ports depending on their function.

The operation of valve 40 in FIG. 3 is as follows: In the neutral condition, and if the valve is set at a pressure below the maximum system relief pressure, system pressure is applied to passage E which is in turn applied to passage L in the body of valve 40. Port 24, which is shown as plugged, is provided in the body of valve 40 and is connected to passage L and provides added flexibility to the valve. Passage L is connected through threaded port 23 to passage B in valve cap 41. Threaded port 22, which is shown as plugged, is provided in the valve cap 41 and is connected to passage B. Passage B is connected through metering orifice 7 to passage G which will direct pressure against poppet 9 of control 13 and poppet 1 through chamber IH. Poppet 1 in the combined control has a 2:1 pressure effective area ratio in regard to chamber IH and passage E. This means that the effective area on which pressure can be applied to poppet 1 through passage E is 50% less than the effective area which pressure can be applied to poppet 1 through chamber IH. If the pressure in chamber IH is equal to the pressure in passage E then poppet 1 will close. The unbalanced areas allow spring 2 to be a light gauge and the spring can be removed if a near atmosphere unload condition is required. Poppet 1 will remain in the closed position as long as the pressure in chamber IH is greater than 50% of the pressure in passage E.

Fluid cannot pass from passage E to passage F through combined control spool 32 because the tension in spring 4 is adjustable in a range of 60 psi to 300 psi, thereby holding control spool 32 in the closed position.

At a predetermined and adjustable pressure, poppet 9 of control 13 will lift off seat 10, allowing flow from passage G to chamber J. Chamber J is connected to passage F through passage M, port 21 and passage K. The high pressure of control 13 is set by adjustment screw 6 which changes the tension on spring 8. This stabilizes the pressure in chamber IH at the pressure value set by pilot relief control 13. Limiting the pilot flow from passage E to passage G through control orifice 7 eliminates the possibility of flow saturating control 13. Threaded port 20, which is shown as plugged, is provided in valve cap 41 and is connected to chamber J.

Hydrostat spool 32 is an equal area pressure sensitive device, having a 1:1 area ratio between the area of spool 32 acted upon by pressure in chamber IH and the area of spool 32 acted upon by pressure in passage E. Adjustable spring 4 and spring 18 combine to bias spool 32 in the normally closed position by adjustment screw 5. Spool 32 is positioned within poppet 1 and is held by retainer 11. When the pressure in passage E reaches a value greater than the tension of combined springs 4 and 18, spool 32 will begin to open passage E to passage F which allows fluid to flow past spool 32 at a metered rate. Spool 32 will continue to open passage E to passage F until the pressure in passage E is higher than the pressure in chamber IH by the combined tension value of adjustable springs 4 and 18, typically between 60 psi and 300 psi. This adjustable pressure cutoff is not present in known pilot operated relief valves with an unloader. In these prior art devices, an increase in the hydrostat bias causes an increase in unload pressure because of the single piece control.

When the pressure in passage E decreases to a value determined by springs 4 and 18, spool 32 will return to the closed position in reference to passage E and passage F. At a pressure value less than the tension set on spring 8, poppet 9 will seat on seat 10, thereby returning valve 40 to the neutral position.

Figure 4:
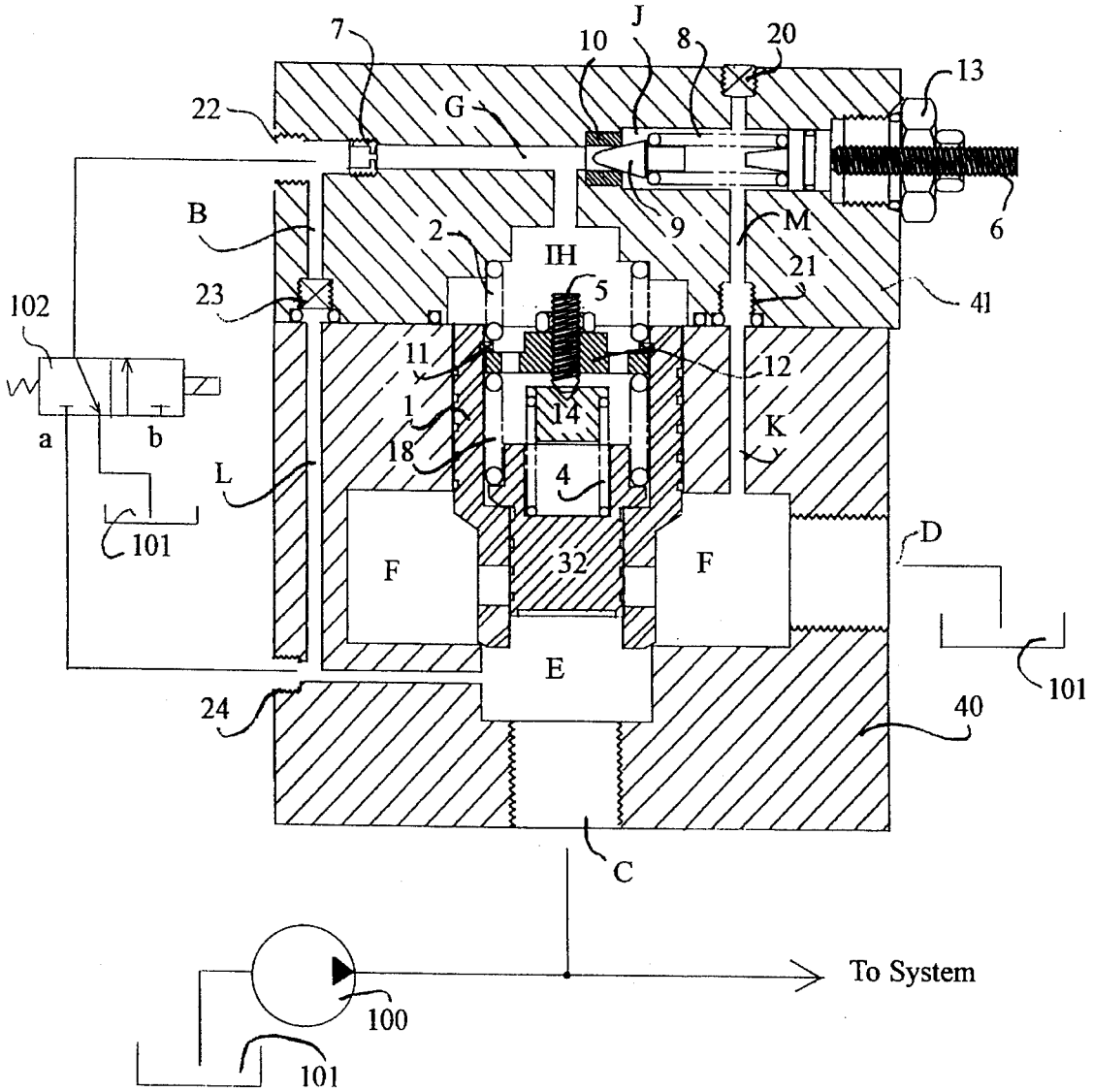
FIG. 4 is a section of the multi-purpose pressure control valve with pilot relief shown in FIG. 3 including a schematic of a pump circuit and a directional load unload valve.

Referring now to FIG. 4 of the drawings, the multi-pressure control valve 40 is a standard pilot operated relief valve with an adjustable pressure cutoff and low unload. Pump 100, reservoir 101 and a two-position, three-way directional control valve 102 are shown schematically. Threaded ports 20, 21, 22, 23 and 24 are either plugged or open depending on their function.

The operation of the valve in FIG. 4 is as follows: In the neutral condition, directional control valve 102 is in position (a). The directional control valve 102 could be contained within pressure control valve 40. With valve 102 in position (a), the flow or pressure present in passage E is directed through threaded port 24 to a blocked port in directional control valve 102. Threaded port 23 is blocked preventing communication between passage L and passage B. Chamber IH is connected through passage G, orifice 7 and threaded port 22 to directional control valve 102. Chamber IH is connected to reservoir 101 through valve 102 in position (a). The fluid is discharged from pump 100 to the system and is connected to multi-purpose valve 40 through port C to passage E. Spring 2, which is of a light gauge equal to about a 2.5 psi pressure drop, is biasing the combined control including springs 4 and 18, adjustment screw 5, poppet 1 and spool 32 to the closed position. The combined control will begin to be depressed by the pressure exerted against the area of poppet 1 in reference to passage E. At a low pressure of about 2.5 psi in passage E, poppet 1 will move enough to connect passage E to passage F allowing the fluid to pass from passage E through passage F and out port D to reservoir 101. Fluid cannot pass from passage E to F through combined control spool 32 as the combined tension in springs 4 and 18 is adjustable in a range of 60 psi to 300 psi, thereby holding spool 32 in the closed position. At this time, all of the flow from pump 100 is passing through the combined control to reservoir 101 at a relatively low pressure drop.

When directional control valve 102 is activated into the flow condition, shown in position (b), the pressure and flow in passage E is directed through threaded port 24, directional control valve 102, threaded port 22, orifice 7 and passage G to chamber IH and therein directed against poppet 1. The pressure is also directed against poppet 9 in passage G.

Poppet 1 in the combined control has a 2:1 pressure effective area ratio with respect to the area of poppet 1 acted upon by pressure in chamber IH and the area of poppet 1 acted upon by pressure in passage E. The unbalanced areas allow spring to be of a light gauge and to be removed if a near atmosphere unload condition is required. The effective area on which pressure can be applied to poppet 1 through passage E is 50% less than the effective area which pressure can be applied to poppet through chamber IH. If the pressure in chamber IH is equal to the pressure in passage E poppet 1 will close. This causes poppet 1 to move to the closed position as long as the pressure in chamber IH is greater than 50% of the pressure in passage E thereby closing off passage E to passage F. Fluid at this time cannot pass from passage E to F through combined control spool 32 as the combined tension in springs 4 and 18 is adjustable in a range of 60 psi to 300 psi, thereby holding spool 32 in the closed position. With valve 102 in position (b) valve 40 will function as previously described as a pilot operated relief valve with adjustable pressure cutoff as shown in FIG. 3.

When directional control valve 102 is returned to the normal position (a), the pressure in chamber IH will be connected to reservoir 101 as previously mentioned. Poppet 1 will compress spring 2 due to the pressure in chamber E, allowing all of the flow to go from passage E to passage F and to reservoir 101 at a low unload pressure of near atmosphere.

Figure 5:
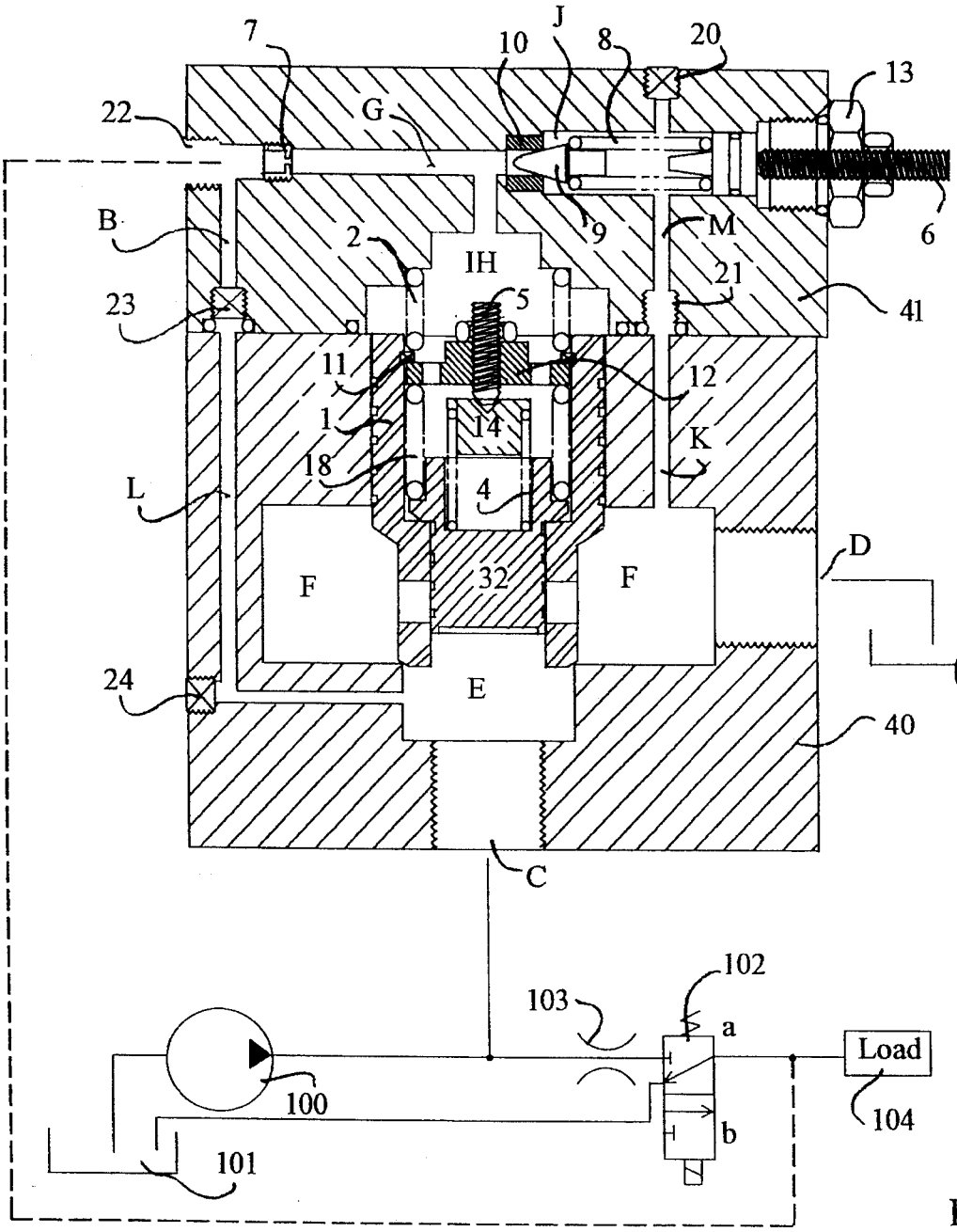
FIG. 5 is a section of the multi-purpose pressure control valve with pilot relief shown in FIG. 3 used as a bypass style compensator with adjustable bias and including a schematic of a pump load sense circuit.

FIG. 5 of the drawings shows multi-pressure control valve 40 as an adjustable bypass style compensator with pilot operated relief and low unload. Pump 100, reservoir 101, a two-position, three-way directional control valve 102, a fixed or variable flow control orifice 103 and a load 104 are shown schematically. Threaded ports 20, 21, 22, 23 and 24 are shown as plugged or open depending on their function.

The operation of the valve shown in FIG. 4 is as follows: In the neutral condition, directional control valve 102 is in position (a) to block all flow from pump 100 and to allow pressure in load 104 to be zero by connecting load 104 to reservoir 101 through directional control 102.

Hydraulic fluid is pulled directly from reservoir 101 by pump 100 and is discharged through port C to passage E. The hydraulic fluid flows from passage E through passage L and is deadheaded by plugged ports 23 and 24. Pump 100 is also connected, through control orifice 103, to the blocked port in directional control valve 102 thus deadheading the pressure line. Threaded port 22 is a load sensing port being connected to load 104. Load 104 is at zero pressure through directional control valve 102 in position (a), thereby making the pressure applied to threaded port 22 of multi-purpose pressure control valve 40 zero psi. Since no fluid flow is present past the pressure blocked port in control valve 102, load sense port 22 receives only reservoir pressure in passage G and so does chamber IH of the combined control. Poppet 1 in the combined control has a 2:1 pressure effective area ratio between the area of poppet 1 acted upon by the pressure in chamber IH and the area of poppet 1 acted upon by the pressure in passage E. The unbalanced areas allow spring 2 to be of light gauge, equal to about a 2.5 psi pressure drop, and may be removed if a near atmosphere unload condition is desired. If the pressure in chamber IH is reservoir pressure of zero, the amount of pressure in passage E required to open passage E to passage F is equal to the amount of pressure exerted on poppet 1 by spring 2. At a low pressure of 2.5 psi or less in passage E, poppet 1 will move enough to connect passage E to passage F thereby allowing fluid to pass out of port D to reservoir 101. Fluid at this time cannot pass from passage E to passage F through the combined control spool 32 due to the force of springs 4 and 18. Spool 32 is an equal area device having a 1:1 area ratio between the area of spool 32 acted upon by pressure in chamber IH and the area of spool 82 acted upon by pressure in passage E. The tension in combined springs 4 and 18 is adjustable in a range of 60 psi to 300 psi, thereby holding spool 32 in the closed position below this pressure difference between chamber IH and passage E. At this time all of the flow from pump 100 is passing through the combined control to reservoir 101 at a low pressure drop.

When directional control valve 102 is activated to position (b) the load 104 receives flow through control orifice 103 which is directed through valve 102 in position (b). This allows the pressure at passage E to be equal to the pressure in chamber IH, by passage of fluid through load sense port 22, orifice 7 and passage G to chamber IH. The pressure in passage G will also act upon poppet 9 of control 13, moving poppet 9 if the pressure exceeds a set pressure determined by spring 8 and adjusted by screw 6. The combined control contained in poppet 1 will move to the closed position in reference to passage F and passage E. As poppet 1 closes, spool 32 begins to open passage E to passage F modulating the flow and bypassing only enough fluid to maintain a prescribed pressure drop. The pressure in passage E and chamber IH continues to increase as the poppet closes causing combined control spool 32 to begin to open due to the bias set on the control. This pressure drop is variable for multi-valve use and is regulated by screw 5 which controls the tension on springs 4 and 18 in relation to combined control spool 32. The spool 32 is the only truly biased control. As passage G senses load pressure and this pressure is applied to chamber IH of the combined control, the total pressure in passage E is spring tension plus load pressure.

If the pump output flow, due to downstream restrictions in the piping or directional control valve 102 is not sufficient, the tension in springs 4 and 18 can be increased by adjusting screw 5 on the combined control. Pressure increases with load until the setting on control 13 is reached.

At a predetermined and adjustable pressure, poppet 9 lifts off seat 10 to allow flow from passage G to chamber J. The flow continues from chamber J, through passage M, open port 21, passage K, passage F and port D to reservoir 101. The high pressure in control 13 is set by screw 6 to change the tension on spring 8. This reduces the pressure in chamber IH allowing more flow to passage F from passage E to keep the pressure from exceeding the preset valve in control 13. If the controlled response is too fast, orifice 7 may be altered in size to cause a control response lag via controlled leakage to passage G.

When directional control valve 102 returns to the neutral position (a), multi-purpose pressure control valve 40 returns to the first mentioned low unload condition.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A pressure control valve comprising:

a housing;

a main inlet passage located in said housing;

a bypass outlet passage located in said housing and adapted to be connected to a reservoir;

combined control means located in said housing between said main inlet passage and said bypass outlet passage for controlling fluid flow from said main inlet passage to said bypass outlet passage, said combined control means including:

i) a chamber located in said housing having an inlet opening connected to said main inlet passage, an outlet opening connected to said bypass outlet opening, and a loading opening, ii) a poppet movably positioned within said chamber and movable between a first position closing said inlet opening and a second position spaced from said inlet opening to allow fluid communication between said main inlet passage and said bypass outlet passage through said combined control, said poppet having an effective surface area ratio of 2:1 between an area of said poppet acted upon by pressure from said loading opening and an area of said poppet acted upon by pressure from said inlet opening, iii) a spool positioned within said poppet and movable between a closed position and an open position allowing fluid communication between said main inlet passage and said bypass outlet passage through said poppet of said combined control, said spool having an effective surface area ratio of 1:1 between an area of said spool acted upon by pressure from said loading opening and an area of said spool acted upon by pressure from said inlet opening, iv) an adjustable spring means for biasing said spool towards said closed position;

a connecting passage located within said housing and outside of said chamber, said connecting passage connecting said main inlet passage and said loading opening; and a metering orifice located within said connecting passage.

2. A valve as set forth in claim 1 further including overload control means located in said housing between said connecting passage and said bypass outlet passage for controlling fluid flow from said connecting passage to said bypass outlet passage, said overload control including:

i) an overload chamber located in said housing having an overload inlet opening connected to said connecting passage and an unloading opening, ii) an overload passage connecting said unloading opening and said bypass outlet opening, iii) an overload poppet movably positioned within said overload chamber and movable between a first position closing said overload inlet opening and a second position spaced from said overload inlet opening to allow fluid communication between said connecting passage and said bypass outlet passage through said overload control means, and iv) an adjustable spring means for biasing said overload poppet toward said first position.

3. A valve as set forth in claim 1 wherein said connecting passage includes:

i) an upper passage connected to said loading opening and wherein said metering orifice is located therein, ii) a lower passage connected to said main inlet opening, and iii) a plug member positioned within said housing between said upper passage and said lower passage to prevent fluid flow between said main inlet opening and said loading opening through said connecting passage.

4. A valve as set forth in claim 3 further including means for connecting said upper passage to load pressure.

5. A valve as set forth in claim 4 further including means for connecting an outlet side of a pump to said main inlet opening and to a system including a metering orifice, a directional valve and a load to form said load pressure.

6. A valve as set forth in claim 5 wherein said directional valve is adapted to connect said load to a reservoir in a first position and to connect said pump to said load in a second position.

7. A valve as set forth in claim 1 further including means for connecting an outlet side of a pump to said main inlet opening and to a system.

8. A valve as set forth in claim 1 wherein said housing includes a valve body and a separate valve cap.

9. A pressure control valve comprising:

a housing;

a main inlet passage located in said housing;

a bypass outlet passage located in said housing and adapted to be connected to a reservoir;

combined control means located in said housing between said main inlet passage and said bypass outlet passage for controlling fluid flow from said main inlet passage to said bypass outlet passage, said combined control means including:

i) a chamber located in said housing having an inlet opening connected to said main inlet passage, an outlet opening connected to said bypass outlet opening, and a loading opening, ii) a poppet movably positioned within said chamber and movable between a first position closing said inlet opening and a second position spaced from said inlet opening to allow fluid communication between said main inlet passage and said bypass outlet passage through said combined control, said popper having an effective surface area ratio of 2:1 between an area of said poppet acted upon by pressure from said loading opening and an area of said poppet acted upon by pressure from said inlet opening, iii) a spool positioned within said poppet and movable between a closed position and an open position allowing fluid communication between said main inlet passage and said bypass outlet passage through said poppet of said combined control, said spool having an effective surface area ratio of 1:1 between an area of said spool acted upon by pressure from said loading opening and an area of said spool acted upon by pressure from said inlet opening, iv) an adjustable spring means for biasing said spool towards said closed position;

a connecting passage located within said housing and connecting said main inlet passage and said loading opening, wherein said connecting passage includes:

i) an upper passage connected to said loading opening, ii) a lower passage connected to said main inlet opening, and iii) a plug member positioned within said housing between said upper passage and said lower passage to prevent fluid flow between said main inlet opening and said loading opening through said connecting passage, and iv) a metering orifice located within said upper passage of said connecting passage; and further including a directional control valve connected to said upper passage and said lower passage, wherein with said directional control valve in a first position fluid flow from said lower passage is blocked and said upper passage is adapted to be connected to a reservoir through said directional control valve, and wherein with said directional control valve in a second position said lower passage is connected to said upper passage through said directional control valve.

* * * * *